US007000659B1

(12) United States Patent
McCray et al.

(10) Patent No.: US 7,000,659 B1
(45) Date of Patent: Feb. 21, 2006

(54) ADZER MOUNT ASSEMBLY

(75) Inventors: Phil McCray, Wetumpka, AL (US); Mark Plyler, Notasulga, AL (US)

(73) Assignee: Knox Kershaw, Inc., Montgomery, AL (US)

( * ) Notice: Subject to any disclaimer, the term of this patent is extended or adjusted under 35 U.S.C. 154(b) by 0 days.

(21) Appl. No.: 10/973,932

(22) Filed: Oct. 26, 2004

(51) Int. Cl.
*B27C 5/00* (2006.01)

(52) U.S. Cl. ..... 144/133.3; 144/133.1; 144/252.1; 144/3.1; 144/367

(58) Field of Classification Search ..... 144/133.3, 144/133.1, 133.2, 252.1, 3.1, 367; 104/2, 104/119
See application file for complete search history.

(56) References Cited

U.S. PATENT DOCUMENTS

| | | | | | |
|---|---|---|---|---|---|
| 1,704,273 | A | * | 3/1929 | Alinder et al. | 144/386 |
| 2,336,652 | A | * | 12/1943 | Talboys | 144/133.3 |
| 2,527,668 | A | * | 10/1950 | Woolery | 144/133.3 |
| 2,887,135 | A | * | 5/1959 | Fox et al. | 144/133.2 |
| 2,923,331 | A | * | 2/1960 | Talboys | 144/133.1 |
| 4,848,426 | A | * | 7/1989 | Whitaker, Jr. | 144/133.3 |

* cited by examiner

*Primary Examiner*—Bena Miller
(74) *Attorney, Agent, or Firm*—Gerald M. Walsh; Kenneth M. Bush; Bush IP Law Group, LLC

(57) ABSTRACT

An adzer mount assembly having a slider box with a vertical slider and horizontal sliders. The vertical slider has an adzer which can be precisely positioned over a crosstie by hydraulic transverse movement of the slider box and vertical movement of the vertical slider. Because the horizontal sliders are mounted firmly to the frame of a railroad adzer machine the adzer is maintained firmly in a precise position over the crosstie during cutting, allowing precision planeing and surfacing of the crosstie.

8 Claims, 4 Drawing Sheets

ADZER MOUNT ASSEMBLY

BACKGROUND OF THE INVENTION

1. Field of the Invention

The present invention relates to railroad track maintenance equipment, and more particularly, to an adjustable mounting system for an adzer used in re-laying railroad tracks.

2. Technical Background

A common machine used in the process of replacing rails of a railroad track is a railroad adzer machine that has a tie adzer. Over a period of time, as trains pass along the rails of a railroad track, the weight of the trains pressing on the rails causes the tie plates, which support the rails, to cut a recess area in the top of the crossties. When an old rail has been removed, and the tie plates are taken up, the old spike holes in the crossties are plugged. It is necessary to adze a smooth surface on the crossties before the tie plates are reinstalled. The tie adzer machine has a cutterhead assembly that planes the surface on each crosstie where the tie plates will sit.

As a tie adzer works along the track bed adzing the tie plate area, one side of the machine is supported by rail wheels running on the rail that is still in place. The other side of the machine is typically supported by crawler assemblies, since there is no rail in place for support. These crawler assemblies normally provide the motive power to move the machine along the track bed. A typical arrangement is for these crawler assemblies to be positioned near the ends of the crossties. Since the elevation of the crossties near their ends can vary considerably, the machine (and therefore the cutter head) tend to move up and down as the crawlers travel over the irregular crosstie ends. There is also the likelihood that ballast rocks may be on the crosstie ends, and when the crawlers travel over the rocks, this adds to the up and down movement. This means that the operator must maneuver the adzer cutterhead up and down to compensate for the machine's up and down movement to attain a smooth, consistent surface on the crossties.

On a typical tie adzer there is a support means for the cutterhead, a means to hydraulically raise and lower the cutterhead relative to the tie, and a means to manually adjust the cutterhead position transversely along the length of the tie. The cutterhead is raised for machine travel to and from the work site. For adzing, the cutterhead is lowered to the correct elevation to plane the tie surface. The ties are planed as the machine slowly moves along the track bed. It is sometimes necessary to adjust the cutterhead position transversely so that the adzer surface will be positioned correctly, dependent on the type of tie plate used. This transverse adjustment is a manual screw type adjustment, which is inconvenient, laborious, and time consuming. In addition, the support means for the cutterhead is inherently flexible on current machines and it is likely to bend. When this happens, it is difficult to keep the adzed surface of the ties in the same plane.

What is needed, therefore, is a means for powered transverse adjustment of the adzer, and a more stable support means.

SUMMARY OF THE INVENTION

The adzer mount assembly of the present invention has a slider box having a vertical channel and two horizontal channels. A vertical slider fits through the vertical channel and has an adzer cutterhead attached at its bottom end. A vertical slide cylinder is attached to the vertical slider and slider box to raise and lower the vertical slider, thereby raising and lowering the cutterhead. Horizontal sliders fit through the horizontal channels of the slider box so that the slider box slides transversely across the horizontal sliders, thereby moving the adzer transversely. The horizontal sliders are attached to mounts which are part of the frame of a railroad adzer machine. A horizontal slide cylinder is attached to one of the mounts and to the slider box to move the slider box transversely back and forth across the horizontal sliders.

An advantage of the adzer mount assembly of the present invention is stable horizontal and vertical positioning of the adzer cutterhead.

Another advantage is the positioning of the adzer horizontally and vertically by powered cylinders.

Another advantage is the decreased time and labor required to set up the machine to adze railroad ties.

Another advantage is a stable adzer mount assembly that resists flexing and bending, and is simple and inexpensive to construct.

Another advantage is improved control of the depth of cut and flatness of the planed surface on the crosstie.

DETAILED DESCRIPTION OF THE PREFERRED EMBODIMENTS

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

Figure 1:
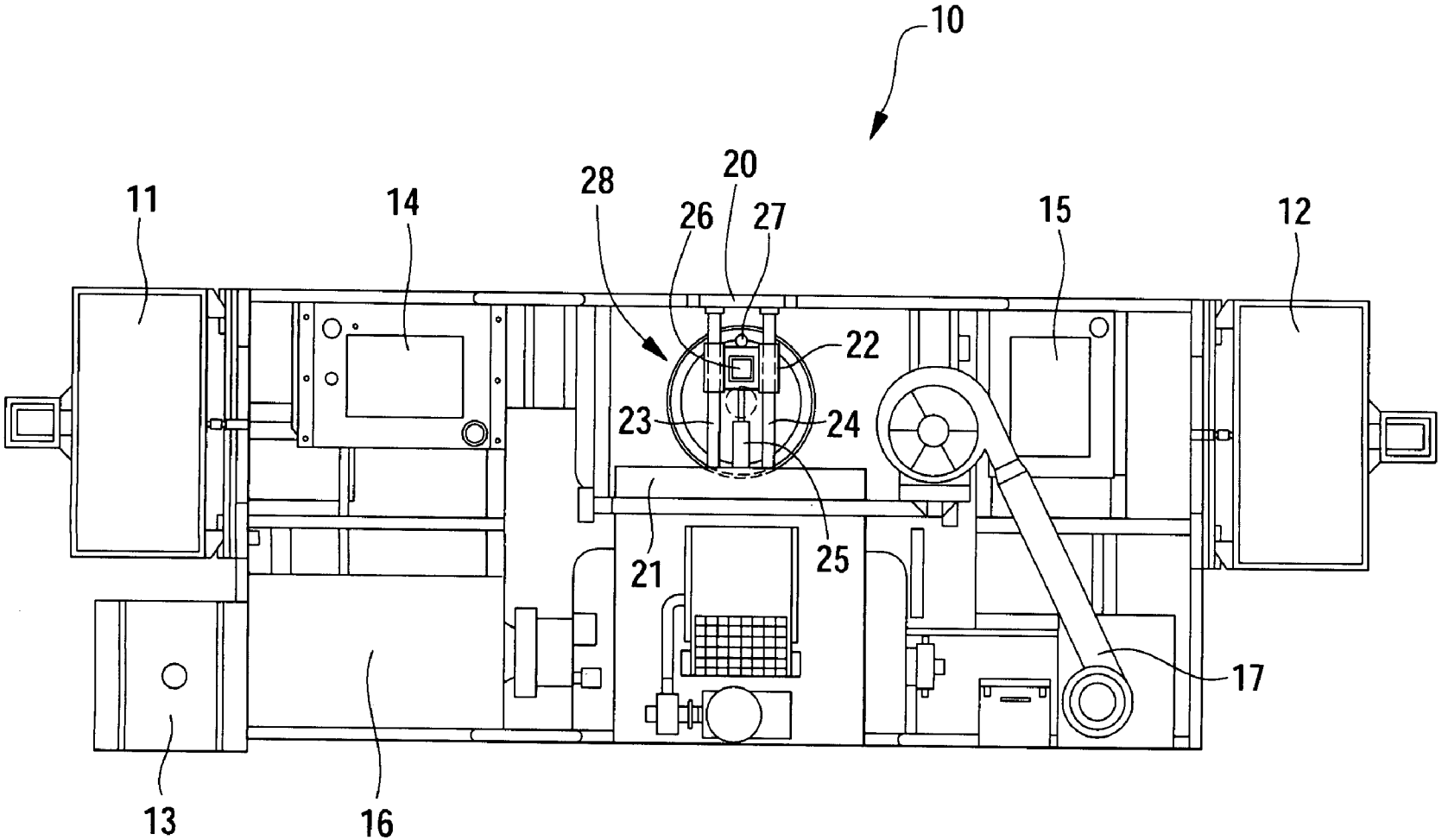
FIG. 1 shows a top view illustration of a railroad adzer machine with the adzer mount assembly of the present invention.

FIG. 1 illustrates a railroad tie adzer machine 10. Key elements of tie adzer machine 10 include a first kribber 11, a second kribber 12, a water tank 13, a hydraulic system 14, a fuel tank 15, an engine assembly 16, a vacuum blower 17, and an adzer cutterhead assembly 28. Hydraulic system 14 provides power to adzer cutterhead assembly 28, to travel functions, to cribber motors, and to all hydraulic cylinder functions. Vacuum blower 17 pulls debris from the adzer cutterhead assembly 28 into a blower, and from there the material is blown into a separator. The material drops out of the bottom of the separator, while air flow is discharged out the stack pipe at the top. The kribber on the leading end of machine 10 removes ballast and debris from the tie plate area prior to adzing. The kribber on the trailing end of machine 10 sweeps the tie plate area clean after adzing so tie plates can be put in place immediately behind machine 10.

Figure 5:
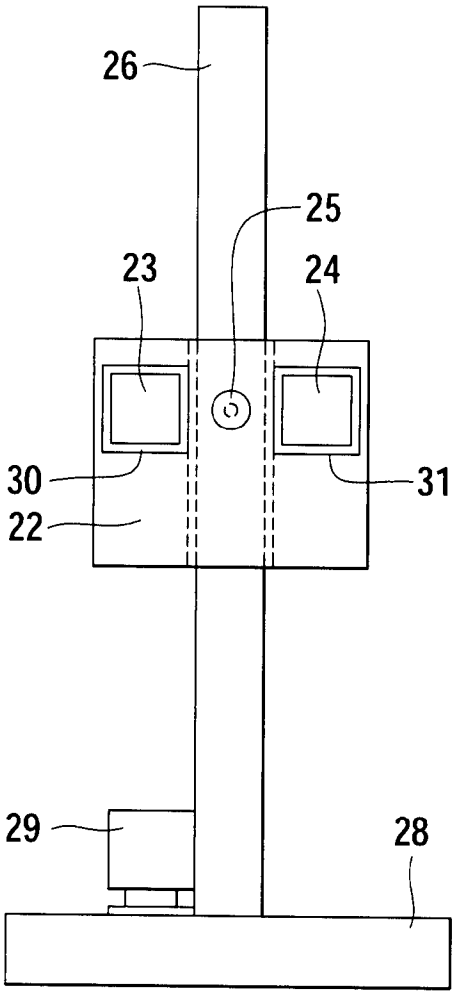
FIG. 5 shows a rear view of the adzer mount assembly.
Figure 4:
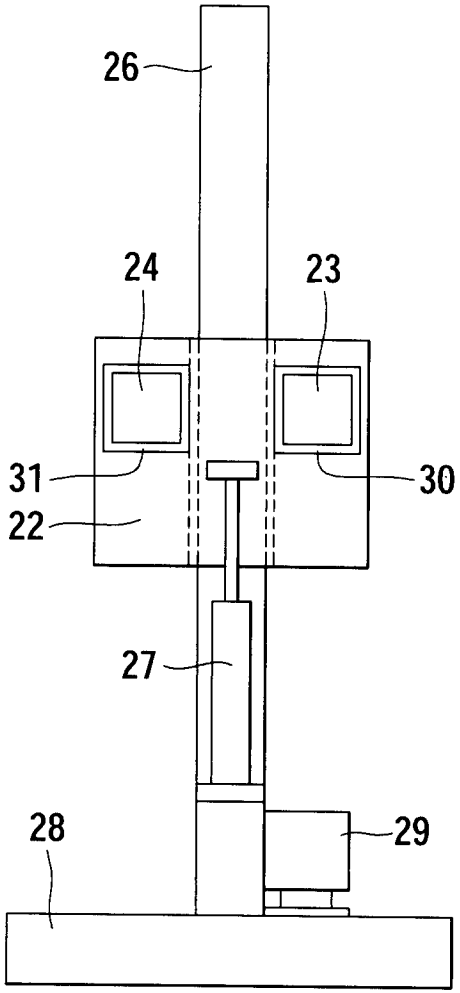
FIG. 4 shows a front view of the adzer mount assembly.

FIGS. 2–5 provide illustrations of the components of the adzer mount assembly of the present invention, showing a top view (FIG. 2), a left side view (FIG. 3), a front view (FIG. 4), and a rear view (FIG. 5).

Slider box 22 has a vertical channel 32. A vertical slider 26 fits into vertical channel 32. Adzer cutterhead unit 28 is attached at the bottom of vertical slider 26. A vertical slide cylinder 27 is attached to the lower end of vertical slider 26 and to the slider box 22.

Figure 3:
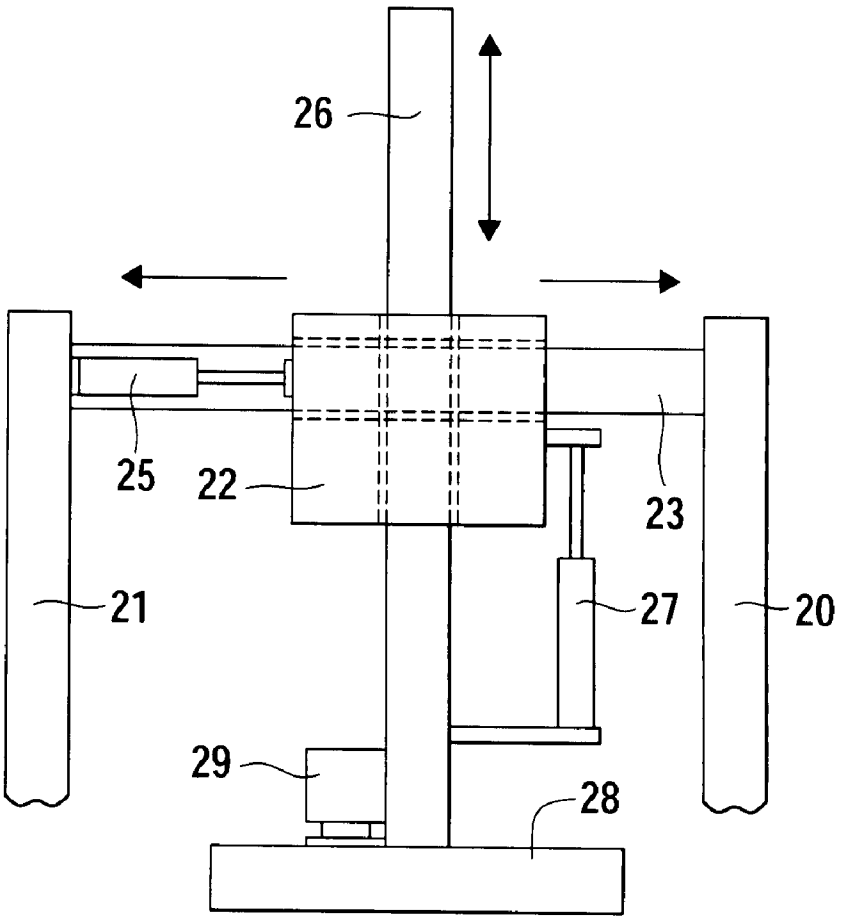
FIG. 3 shows a side view of the adzer mount assembly.
Figure 2:
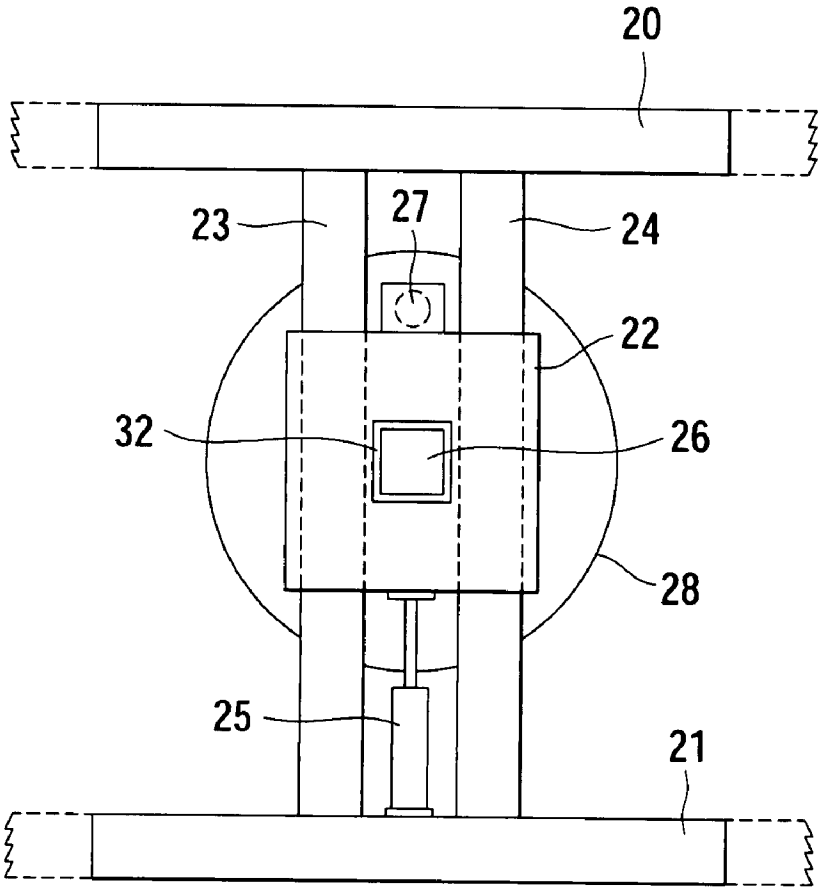
FIG. 2 shows a top view of the adzer mount assembly.

Activation of vertical slide cylinder 27 will raise lower vertical slider 26, as shown by the vertical arrows in FIG. 3, so as to raise or lower adzer cutterhead unit 28. Vertical slide cylinder 27 is preferably a hydraulic cylinder, similar to those well known in the art.

Slider box 22 also has a right horizontal channel 30 and a left horizontal channel 31. A right horizontal slider 23 fits through right horizontal channel 30, and a left horizontal slider 24 fits through left horizontal channel 31. Horizontal sliders 23 and 24 are then attached to a front mount 20 and to a rear mount 21 which are part of the frame of machine 10. Slider box 22 can then slide transversely across horizontal sliders 23 and 24. A horizontal slide cylinder 25 is attached to rear mount 21 and slider box 22. Activation of horizontal slide cylinder 25 will move slider box 22 towards or away from mounts 20 and 21, as shown by the horizontal arrows in FIG. 3, so as to move adzer unit 28 transversely back and forth over a crosstie. Horizontal slide cylinder 25 is, preferably, a hydraulic cylinder, similar to those well known in the art.

As an operator moves machine 10 into position over a crosstie, an operator can lower adzer cutterhead unit 28 onto the crosstie by activation of vertical slide cylinder 27. The operator can then position the adzer cutterhead unit 28 transversely across the crosstie as desired by activation of horizontal slide cylinder 25. The cutting depth produced by adzer cutterhead unit 28 can also be controlled by the operator by activation of vertical slide cylinder 27. The adzer cutterhead unit 28 is activated for cutting by a drive unit 29 attached to the adzer cutterhead unit 28's cutting mechanism. Because horizontal sliders are attached firmly to mounts 20, 21 on the frame of machine 10, adzer cutterhead unit 28 is maintained firmly in a precise position over the crosstie during cutting. This precise positioning produces precision planeing and surfacing of the crosstie.

Figure 7:
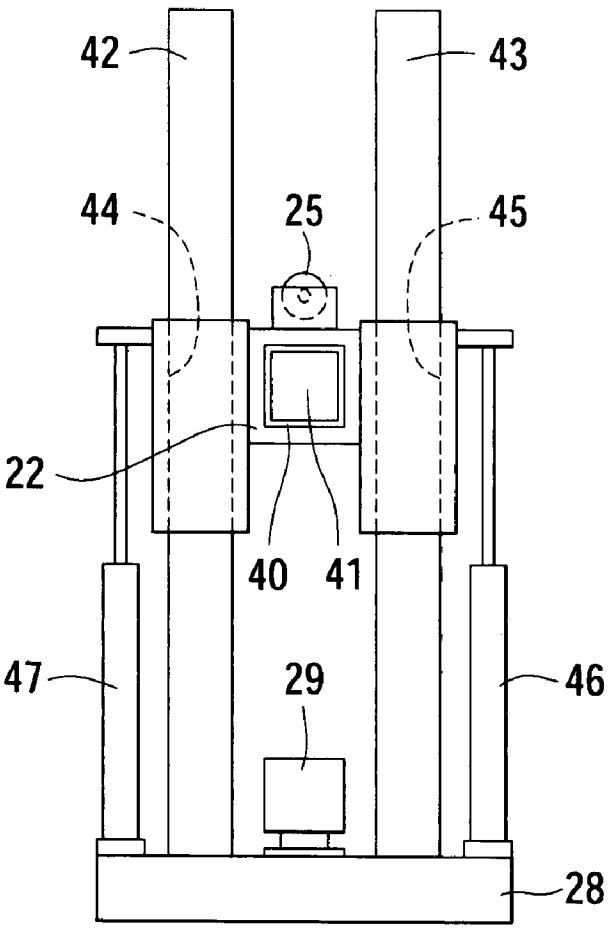
FIG. 7 shows an alternate embodiment having a single horizontal slider, two vertical sliders, and two horizontal slide cylinders.
Figure 6:
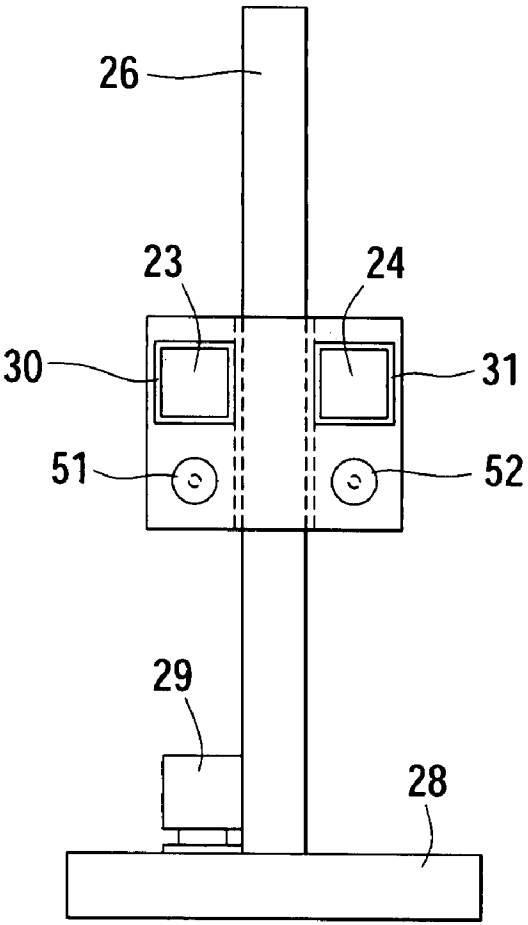
FIG. 6 shows an alternate embodiment of the present invention having two horizontal slide cylinders.

The present invention can be constructed with other embodiments but still operate on the same underlying principles. For example, FIG. 6 shows an embodiment having two horizontal slide cylinders 51 and 52. FIG. 7 shows another embodiment, for example, having a slider box 22 with a single horizontal channel 40 containing a single horizontal slider 41 therein. Slider box 22 also has a first vertical channel 44 with a first vertical slider 42 and a first vertical slide cylinder 47; and a second vertical channel 45 with a second vertical slider 43 and a second vertical slide cylinder 46. Thus, the present invention can have one or more slider boxes, one or more horizontal channels, one or more vertical channels, one or more horizontal sliders, one or more vertical sliders, one or more horizontal slide cylinders, and one or more vertical slide cylinders.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the adzer mount assembly can be located in any suitable place on a railroad adzer machine. Any suitable type slide cylinder mechanism can be used, including pneumatic. The mount assembly can be constructed of any suitable material, preferably metal. Any type of adzer unit can be used.

It will be understood that various changes in the details, materials, and arrangements of the parts which have been described and illustrated above in order to explain the nature of this invention may be made by those skilled in the art without departing from the principle and scope of the invention as recited in the following claims.

We claim:

1. An adzer mount assembly, comprising:

a) a slider box having one or more horizontal channels and one or more vertical channels;

b) one or more horizontal sliders fitting through said one or more horizontal channels;

c) one or more vertical sliders fitting through said one or more vertical channels, said one or more vertical sliders having an adzer cutterhead;

d) one or more horizontal slide cylinders attached to said slider box to move said slider box in a transverse direction across said one or more horizontal sliders; and e) said one or more vertical slide cylinders attached to said one or more vertical sliders to move said one or more vertical sliders through said one or more vertical channels in a vertical direction.

2. The adzer mount assembly of claim 1, further comprising mounts for the attachment of said one or more horizontal sliders.

3. The adzer mount assembly of claim 2 wherein said one or more horizontal slide cylinders are attached to one of said mounts.

4. The adzer mount assembly of claim 1 wherein said one or more vertical slide cylinders are attached to said slider box.

5. An adzer mount assembly, comprising:

a) a slider box having one or more horizontal channels and one or more vertical channels;

b) one or more horizontal sliders fitting through said one or more horizontal channels;

c) one or more vertical sliders fitting through said one or more vertical channels, said one or more vertical sliders having an adzer;

d) one or more horizontal slide cylinders attached to said slider box to move said slider box in a transverse direction across said one or more horizontal sliders;

e) one or more vertical slide cylinders attached to said one or more vertical sliders to move said one or more vertical sliders through said one or more vertical channels in a vertical direction; and f) mounts for attachment of said one or more horizontal sliders.

6. The adzer mount assembly of claim 5 wherein said one or more horizontal slide cylinders are attached to one of said mounts.

7. The adzer mount assembly of claim 5 wherein said one or more vertical slide cylinder is attached to said slider box.

8. An adzer mount assembly, comprising:

a) a slider box having one or more horizontal channels and one or more vertical channels;

b) one or more horizontal sliders fitting through said one or more horizontal channels;

c) one or more vertical sliders fitting through said one or more vertical channels, said one or more vertical sliders having an adzer;

d) one or more horizontal slide cylinders attached to said slider box to move said slider box in a transverse direction across said one or more horizontal sliders;

e) one or more vertical slide cylinders attached to said one or more vertical sliders and to said slider box to move said one or more vertical sliders through said one or more vertical channels in a vertical direction; and f) mounts for attachment of said one or more horizontal sliders and said one or more horizontal slide cylinders.

* * * * *